US008931419B2

(12) United States Patent
Kuvakin

(10) Patent No.: US 8,931,419 B2
(45) Date of Patent: Jan. 13, 2015

(54) SIMULTANEOUSLY MOVABLE AND TILTABLE WORKTOP FOR STUDY DESKS AND WRITING TABLES

(76) Inventor: Evgeny Yur'evich Kuvakin, Yaroslavl (RU)

( * ) Notice: Subject to any disclaimer, the term of this patent is extended or adjusted under 35 U.S.C. 154(b) by 0 days.

(21) Appl. No.: 14/008,547

(22) PCT Filed: Jul. 3, 2012

(86) PCT No.: PCT/RU2012/000531

§ 371 (c)(1),
(2), (4) Date: Sep. 28, 2013

(87) PCT Pub. No.: WO2013/006097

PCT Pub. Date: Jan. 10, 2013

(65) Prior Publication Data

US 2014/0102336 A1 Apr. 17, 2014

(30) Foreign Application Priority Data

Jul. 4, 2011 (RU) ..... 2011127063

(51) Int. Cl.

| | |
|---|---|
| ***A47B 17/00*** | (2006.01) |
| ***A47B 13/02*** | (2006.01) |
| ***A47B 27/18*** | (2006.01) |
| ***A47B 41/02*** | (2006.01) |

(52) U.S. Cl.

CPC ..... *A47B 17/00* (2013.01); *A47B 13/02* (2013.01); *A47B 27/18* (2013.01); *A47B 41/02* (2013.01)

USPC ..... 108/4

(58) Field of Classification Search

CPC ..... A47B 27/02; A47B 2200/0043; A47B 17/02; A47B 19/06; A47B 27/14; A47B 27/18; A47B 2023/047; A47B 46/005

USPC ..... 108/4–8, 146, 147; 248/585, 157, 277.1

See application file for complete search history.

(56) References Cited

U.S. PATENT DOCUMENTS

| | | | | | |
|---|---|---|---|---|---|
| 651,638 | A | * | 6/1900 | Norris | 108/145 |
| 705,509 | A | * | 7/1902 | Anderson | 312/27 |
| 1,689,445 | A | * | 10/1928 | Merriman | 108/106 |
| 3,347,184 | A | * | 10/1967 | Kiraly | 108/17 |
| 4,736,690 | A | * | 4/1988 | Van Norman | 108/35 |

(Continued)

FOREIGN PATENT DOCUMENTS

| | | |
|---|---|---|
| DE | 19823259 | 12/1999 |
| DE | 10141483 | 3/2003 |

*Primary Examiner* — Janet M Wilkens

(74) *Attorney, Agent, or Firm* — Aleksandr Smushkovich

(57) ABSTRACT

A writing table or a desk includes a frame, a worktop, four hinged axes, a first pivotal panel, a second pivotal panel being wider than the first panel, two limit stops, and a rotatable handle. The worktop is attached via a first axis to the first panel connected via a second axis with the frame. The worktop is attached via a third axis to the second panel connected via a fourth axis with the frame. A first limit stop is secured on a first side of the frame and limits the rotation of the first panel. A second limit stop is secured on a second side, being opposite to the first side, of the frame and limits the rotation of the second panel. The handle is immovably mounted on the first panel to provide moving the worktop by one hand of a user of the writing table or the desk.

2 Claims, 3 Drawing Sheets

(56) References Cited

U.S. PATENT DOCUMENTS 5,375,514 A * 12/1994 Dann, Jr. ..... 100/145
6,038,982 A * 3/2000 Witzig ..... 108/3
7,654,208 B2 * 2/2010 Patten ..... 108/96
2013/0014674 A1 * 1/2013 Burkhalter ..... 108/50.11

* cited by examiner

SIMULTANEOUSLY MOVABLE AND TILTABLE WORKTOP FOR STUDY DESKS AND WRITING TABLES

CROSS-REFERENCE TO RELATED APPLICATIONS

This application is a U.S. national stage application of an international application PCT/RU2012/000531 filed on 3 Jul. 2012, published as WO/2013/006097, which international application claims priority of a Russian Federation patent application RU2011127063 filed on 4 Jul. 2011.

FIELD OF THE INVENTION

The invention relates to articles of educational furniture and can be used for organized learning.

BACKGROUND OF THE INVENTION

The most close to the proposed invention is the study desk (patent of France WO 02/069756 A1, cl. A47B39/02, Dec. 9, 2002), comprising a worktop, and the worktop is formed with the possibility of changing the angle of incline and moving towards the student. The distinction of the claimed invention is the structure of the worktop which implies simultaneous tilt and transfer of the worktop. Tilt and transfer of the worktop in the said closest analogue are carried out independently: the transfer of the worktop is fulfilled along the guides mounted on a supporting framework, and the tilt of the worktop is fulfilled with the aid of the rotation about the horizontal axis in the level of the guides.

In the claimed invention, the tilt and transfer of the worktop are carried out simultaneously by means of rotation of the worktop, connected by a hinged joint, composed of two horizontal axes, to two horizontal axes of a supporting framework, via two essentially planar pivotal panels of different widths, describing circles of different radiuses during rotation. The advantage of this design is a reduction of the number of a user's actions, aimed at the achievement of the requisite result.

AIM AND BRIEF SUMMARY OF THE INVENTION

The essence of the invention is that in a tiltable worktop connected to a supporting framework by a hinged joint, the hinged joint between the worktop and the supporting framework is formed via two pivotal panels of different widths.

The aim of the invention is an improvement of writing tables and study desks with a worktop which can be tilted and moved by means of a single action of the user.

BRIEF DESCRIPTION OF DRAWINGS OF THE INVENTION

While the invention may be susceptible to embodiment in different forms, there will be described in detail herein, specific embodiments of the instant invention, with the understanding that the present disclosure is to be considered an exemplification of the principles of the invention, and is not intended to limit the invention to that as illustrated and described herein.

The structure of the inventive worktop is illustrated in the drawings, wherein.

DETAIL DESCRIPTION OF THE INVENTION

Figure 1:
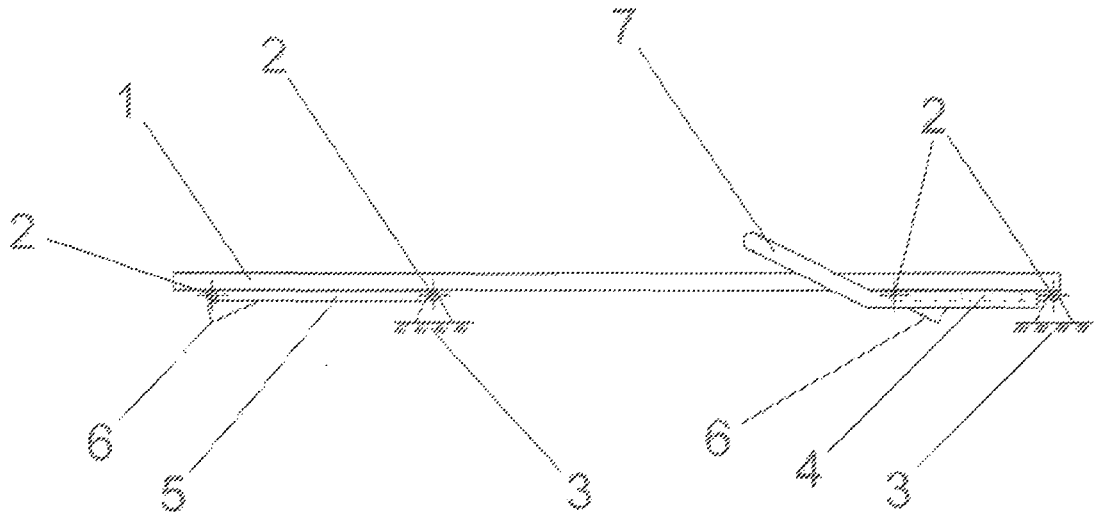
FIG. 1 shows a side view of the worktop with no tilt, according to an embodiment of the invention.

The structure comprises: a worktop (1) (FIGS. 1, 2, 3); four hinged axes (2); a frame (3) a pivotal panel (4) and a pivotal panel (5) being wider than the pivotal panel (4); two limit stops (6); and a rotatable handle (7).

The worktop (1) is attached via a first axis (2) to the pivotal panel (4) being connected via a second axis (2) with the frame (3); the worktop (1) is attached via a third axis (2) to the pivotal panel (5) being connected via a fourth axis (2) with the frame (3). A first limit stop (6) is secured on the left side of the frame (3), and limits the rotation of the pivotal panel (4); whereas a second limit stop (6) is secured on the right side of the frame (3), and limits the rotation of the pivotal panel (5). The rotatable handle (7) is immovably mounted on the pivotal panel (4) to provide moving the worktop (1) by one hand of the user.

Figure 2:
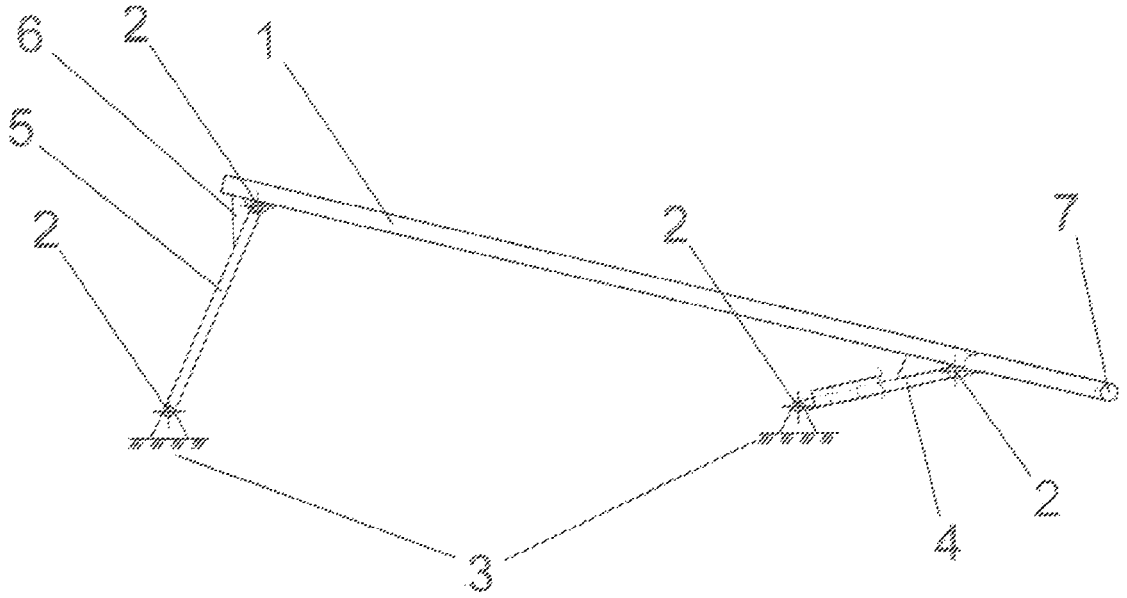
FIG. 2 shows a side view of the worktop tilted, according to an embodiment of the invention.
Figure 3:
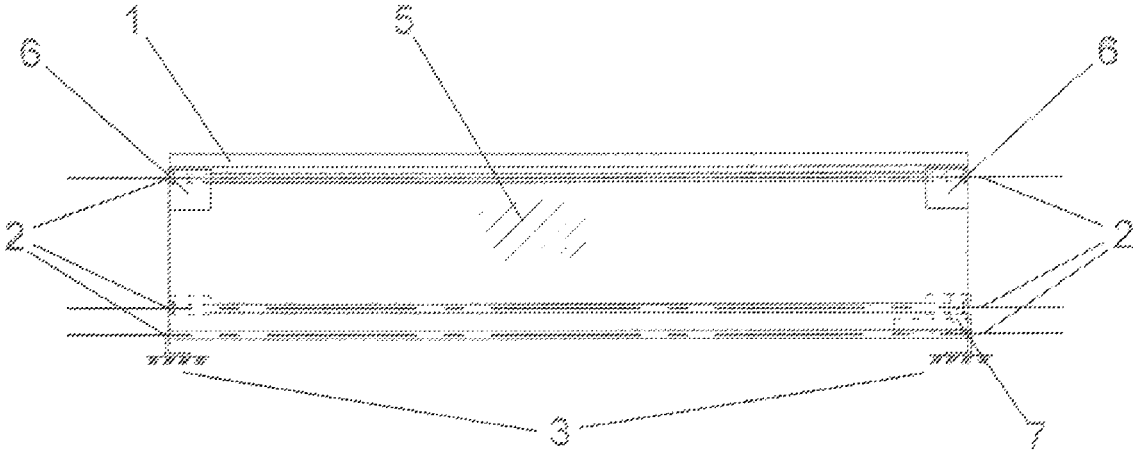
FIG. 3 shows a front view of the worktop tilted, according to an embodiment of the invention.

When the handle (7) (FIG. 1) is rotated, the worktop (1), moves with the aid of the hinged axes (2) and the pivotal panels (4) and (5) towards the seated person and lays on the limit stops (6) (FIGS. 2, 3). Since the pivotal panels (4) and (5) are of different widths, the angle of incline of the worktop to the horizon changes during the rotation.

The requisite result of the use of the proposed study desk worktop is that, by a single movement of the handle, the worktop is transferred from a horizontal into a tilted position while the edge of the worktop is brought closer to the student.

The invention claimed is:

1. A desk comprising:

a frame (3);

a worktop (1);

four hinged axes (2) consisting of a first axis, a second axis, a third axis, and a fourth axis;

a first pivotal panel (4);

a second pivotal panel (5) being wider than the first pivotal panel (4);

two limit stops (6) consisting of a first limit stop and a second limit stop; and a rotatable handle (7);

wherein:

the worktop (1) is attached via the first axis (2) to the first pivotal panel (4) being connected via the second axis (2) with the frame (3);

the worktop (1) is attached via the third axis (2) to the second pivotal panel (5) being connected via the fourth axis (2) with the frame (3);

the first limit stop (6) is secured on a first side of the frame (3), and limits the rotation of the first pivotal panel (4); whereas the second limit stop (6) is secured on a second side, of the frame (3), and limits the rotation of the second pivotal panel (5), said second side being opposite to said first side; and the rotatable handle (7) is immovably mounted on the first pivotal panel (4) to provide moving the worktop (1) by a user of said desk.

2. A writing table comprising:

a frame (3);

a worktop (1);

four hinged axes (2) consisting of a first axis, a second axis, a third axis, and a fourth axis;

a first pivotal panel (4);

a second pivotal panel (5) being wider than the first pivotal panel (4);

two limit stops (6) consisting of a first limit stop and a second limit stop; and a rotatable handle (7);

wherein:

the worktop (1) is attached via the first axis (2) to the first pivotal panel (4) being connected via the second axis (2) with the frame (3);

the worktop (1) is attached via the third axis (2) to the second pivotal panel (5) being connected via the fourth axis (2) with the frame (3);

the first limit stop (6) is secured on a first side of the frame (3), and limits the rotation of the first pivotal panel (4); whereas the second limit stop (6) is secured on a second side, of the frame (3), and limits the rotation of the second pivotal panel (5), said second side being opposite to said first side; and the rotatable handle (7) is immovably mounted on the first pivotal panel (4) to provide moving the worktop (1) by a user of said writing table.

* * * * *